United States Patent [19]

Frazee, Jr.

[11] 4,195,791

[45] Apr. 1, 1980

[54] CATENARY CONTROLLER

[75] Inventor: Ralph E. Frazee, Jr., Spotswood, N.J.

[73] Assignee: Western Electric Company, Incorporated, New York, N.Y.

[21] Appl. No.: 40,026

[22] Filed: May 18, 1979

[51] Int. Cl.[2] ..... B65H 59/38

[52] U.S. Cl. ..... 242/45; 242/75.52

[58] Field of Search ..... 242/45, 75.51, 75.52; 226/10, 24, 41, 42, 43, 44, 45; 318/6, 7

[56] References Cited

U.S. PATENT DOCUMENTS

| | | | |
|---|---|---|---|
| 2,011,653 | 8/1935 | Rufsvold | 242/75.52 |
| 2,147,467 | 2/1939 | Stephenson | 242/75.52 |
| 2,379,132 | 6/1945 | Cook | 242/75.52 |
| 3,357,649 | 12/1967 | Nichols et al. | 242/45 |
| 3,393,880 | 7/1968 | Keith et al. | 242/45 |
| 3,782,649 | 1/1974 | Frederick et al. | 242/75.52 |
| 3,908,920 | 9/1975 | Hermanns | 242/45 |

*Primary Examiner*—Stanley N. Gilreath
*Attorney, Agent, or Firm*—D. J. Kirk

[57] ABSTRACT

A CCTV camera 32 monitors the sag of a loop of optical fiber 11 extending between a drawing mechanism 12 and a takeup spool 18. The camera is rotated 90° about its optical axis so as to vertically scan the plane of the fiber catenary and forward the video scan signal to a video signal processor 28. The processor continuously determines the displacement of the lowest point of the loop from an optimum position and generates an electrical signal proportional thereto. The signal is forwarded to a spooling motor 19 to adjust the speed of the takeup spool to cause the fiber catenary to return to a predetermined position.

10 Claims, 10 Drawing Figures

CATENARY CONTROLLER

TECHNICAL FIELD

This invention is directed to methods and apparatus for controlling the sag depth of a strand continuously moving between a feed and a takeup apparatus. In particular, the invention is directed to continuous control of the sag depth using a closed circuit television (CCTV) camera.

BACKGROUND OF THE INVENTION

In fabricating optical fibers for communication purposes, it is well known to position a cylindrical glass preform in an open-ended furnace in order to form a melt zone in the preform. The fiber is then pulled from the melt by a drawing motor and is further fed to a collecting apparatus, resulting in a free hanging fiber catenary therebetween. Such an arrangement allows the collecting drums or spools to be changed without stopping the fiber draw, which would upset the process equilibrium. Additionally, the fiber is collected at very low tensions, completely independent of the drawing forces. Collection at low tension is desirable in order to minimize damage to the fiber or a coating thereon and reduce the effect of micro-bending on transmission loss measurement.

Such a technique requires that a relationship exist between the rim velocities of the drawing and collecting devices so that an initial sag placed in the fiber between the two devices does not substantially change in depth during the fiber drawing-collecting operation. This would appear to be readily accomplished by slaving the collection system to the drawing device by either an electrical or mechanical means. However, electrical or mechanical changes such as amplifier drift and offset or drum size and shape can alter the relative velocity relationship between the drawing and collecting apparatus, undesirably causing the sag depth of the free hanging fiber to change substantially, resulting in high tension and breakage of the fiber.

Additionally, any system for controlling the depth of sag of such a free hanging catenary must be able to handle both coated and uncoated fiber without touching or otherwise altering the position thereof. Furthermore, physical contact is unacceptable for uncoated fibers are very susceptible to damage and often carry static charges which cause the fiber to cling to objects in close proximity thereto, changing the free hanging tension. Similarly, contacting coated fibers can damage the coating and/or cause variations in the spooling tension.

Various non-contact systems are known for monitoring and controlling the sag depth of a catenary. For instance, U.S. Pat. No. 2,379,132 describes a photoelectric system for producing a control voltage responsive to movements of looped material extending between two work devices. The system comprises a light source and optics for projecting a plurality of horizontally disposed beams of light at a photoelectric device, the beams being positioned so as to be intercepted by the lowest point of the loop as the sag depth of the loop changes. A control voltage which varies inversely with the depth of the sag of the loop is generated to control the speed of the takeup device to alter the sag depth of the loop. However, such a system and similar systems operate beween fixed limits resulting in stepwise alterations in the tension of the fiber. It has been found that the system inertia and slow response times of the equipment result in undesirably wide variations in sag depths when drawing fibers at high speeds.

Thus, there exists a need for substantially continuously adjustable non-contact technique for controlling the sag depth of a catenary formed by a fiber being drawn at high speeds and extending between a feed and a takeup apparatus.

SUMMARY OF THE INVENTION

The instant invention overcomes the foregoing problems with a method for automatically controlling the sag depth of a catenary of material moving between a feed and a takeup apparatus. The method comprises the steps of illuminating the material in the vicinity of the lowest point of the catenary and raster scanning the catenary vertically with a TV camera to provide a video output signal; processing the video signal output to generate an output control voltage representing the displacement of the catenary image from a predetermined location; and adjusting the speed of the takeup apparatus in response to the generated output control voltage to control the sag depth of the catenary.

DETAILED DESCRIPTION

The instant invention will be described in relation to controlling the depth of sag of a free hanging optical fiber as the fiber is being drawn from a preform and spooled onto a reel. However, it will be understood that such description is exemplary only and is for the purpose of exposition and not for limitation. It will readily be appreciated that the disclosed techniques are readily applicable to controlling the depth of sag of a variety of fibers or filaments (e.g., wire) or webs (e.g., flexible circuits; paper) passing between devices.

Figure 1:
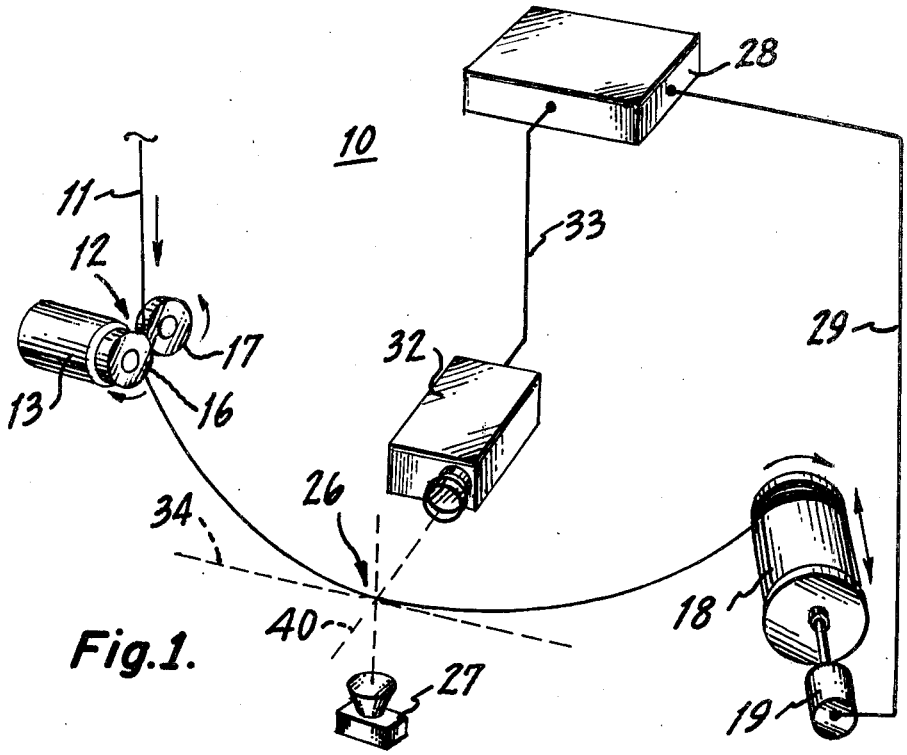
FIG. 1 is an isometric view of the catenary controller embodying features of the instant invention.

FIG. 1 depicts the instant catenary controller which is generally designated by the numeral 10. An optical fiber 11 is drawn from a glass preform (not shown) by a drawing mechanism, generally indicated by the numeral 12, which is comprised of a motor 13, a capstan 16 and a pressure wheel 17. The fiber 11 passes between the capstan 16 and the pressure wheel 17 and is wound onto a rotatable spool 18 which operates under the control of a spooling motor 19. The fiber 11 forms a free hanging loop or catenary 26 between the drawing mechanism 12 and the spool 18 and a light source 27 illuminates the fiber in the vicinity of the lowest point of the catenary. The spooling motor 19 is electrically connected to a video signal processor 28 by a first lead 29. Additionally, a closed circuit television (CCTV) camera 32, optically aligned with the lower portion of the catenary 26, is electrically connected to the video signal processor 28 by a second lead 33. The lowest point of sag in the free hanging catenary 26 has a tangent 34 which is parallel to the horizontal.

Figure 2:
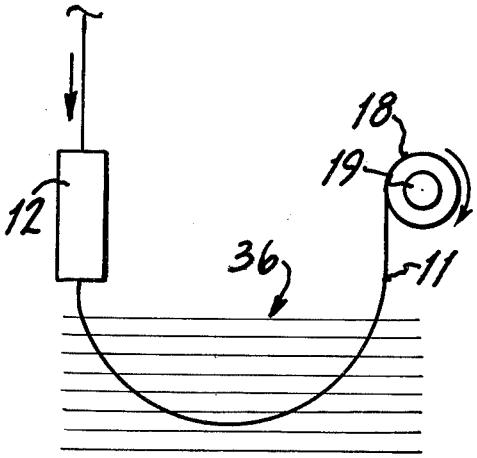
FIG. 2 is a schematic diagram of an optical fiber catenary being raster scanned in the horizontal direction.
Figure 3:
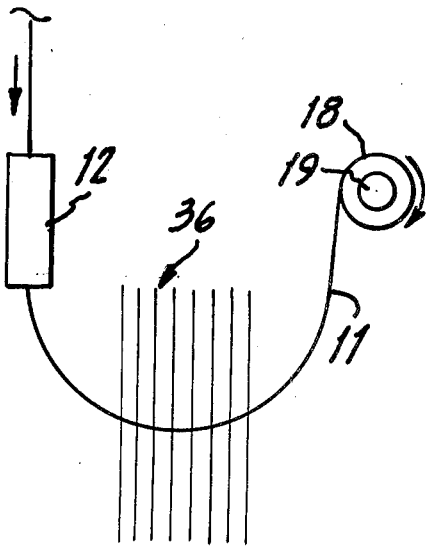
FIG. 3 is a schematic diagram of an optical fiber catenary being raster scanned in the vertical direction.

FIG. 2 depicts a television raster scan of the optical fiber 11 when the camera 32 is mounted in its normal upright condition, the image of the fiber catenary at the lowest point would be intersected by a limited number of the horizontal scans 36—36, possibly none, resulting in unacceptably low resolution. If, however, the camera is rotated 90° about the optical axis 40, as depicted in FIG. 1, several horizontal scans intersect the catenary image (see FIG. 3) in the vicinity of the lowest point of the catenary image, affording a much higher resolution.

The optical fiber 11 illuminated by the light source 27 is substantially normal to both the catenary tangent 34 and the optical axis 40 of the camera 32. This arrangement allows the maximum reflected intensity from the first surface scattering of the optical fiber 11 to be collected by the camera 32. Additionally, a light absorbing material may be placed on the opposite side of the fiber 11 to minimize other reflections and enhance the contrast and insure video detection.

The camera 32 can be positioned at a distance from the fiber 11 which is directly proportional to the height of the catenary 26 above the light source 27 and to the intensity of the light source. As the viewing distance is increased, the field of view and, therefore, the control area becomes larger. In a particular working embodiment, the depth of the catenary 26 was controlled at eighteen cm above the light source 27. This required that the camera 32 be no more than fifty cm away from the optical fiber 11 and light source 27. With the camera 32 placed at fifty cm, the control window is about twenty square cm and the fiber 11 can sway about five cm toward or away from the camera 32 without altering the system resolution.

In operation, generally, the fiber 11 is captured between the capstan 16 and the pressure wheel 17 which are counter rotated by the motor 13 to draw the fiber from the preform (not shown). The drawn fiber 11 is wound onto the spool 18 under control of the motor 19. The fiber catenary 26 is scanned by the camera 32 in the vicinity of the lowest point of the catenary (i.e., the illuminated portion of the fiber 11) and the resulting video signal transmitted over the lead 23 to the video signal processor 28. The processor 28 continuously analyzes the video signal and generates a control voltage which is forwarded to the motor 19 over the first lead 29 to adjust the speed thereof to maintain, or alter, the sag depth of the optical fiber 11.

Actual control of the sag depth of the fiber catenary 26 may be accomplished by first establishing a nominal rotational velocity for the spool 18 which is substantially the same as the rim velocity of the capstan 16. Alternatively, a feed forward control may be established where the spooling motor 19 is slaved to the drawing motor 13 through a fixed ratio. A video signal 41 (see FIG. 5) output from the television camera 32 is input to the video processor 28 which processes the video signal and outputs a bipolar analog control voltage that is related to the displacement of the catenary image from a predetermined sag depth. This control voltage is summed into a feed forward amplifier circuit (not shown) associated with the spooling motor 19 that either speeds up or slows down the spool 18 as required to maintain the sag depth of the fiber 11 at a predetermined elevation.

VIDEO PROCESSOR

Figure 4:
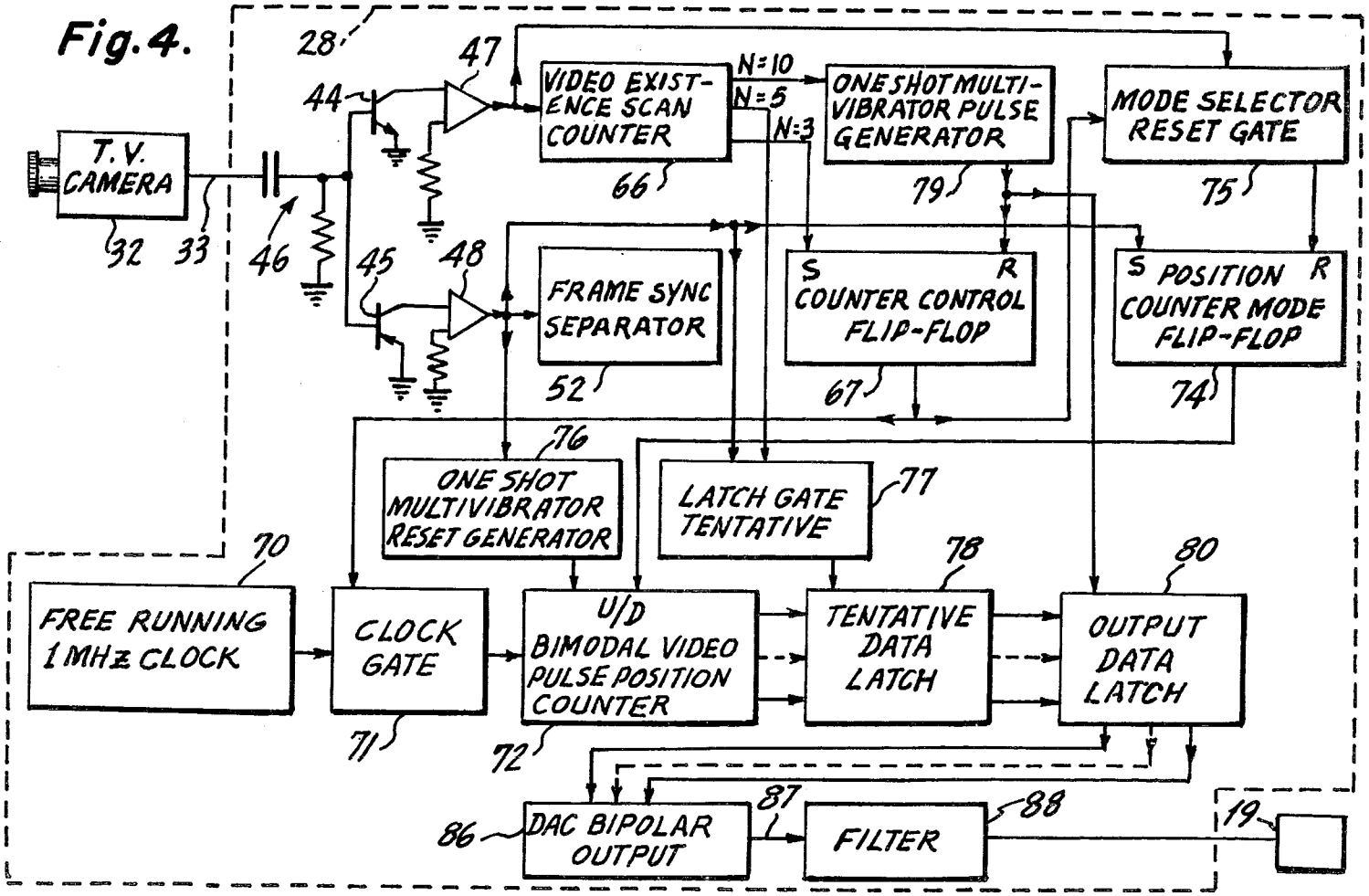
FIG. 4 is an operational block diagram of the catenary controller video processor embodying further features of the instant invention.

The video signal 41 (see FIG. 5) from the television camera 32 is a composite signal that is comprised of horizontal scan line sync pulses 42—42 and video pulses 43—43, which are input to the video processor 28. The composite video signal 41 is applied to an R-C coupling network 46, as shown in FIG. 4, to remove bias coming from the camera 32. The composite video signal 41 is forwarded, in parallel, to a first and second complementary pair of input transistors 44 and 45, respectively, which act as clipper amplifiers. A bias is applied, in a well-known manner, on each of the first and second transistors 44 and 45 to hold the transistors cut off until an appropriate signal polarity is applied. Thus, the transistors 44 and 45 serve to separate the negative going horizontal scan line sync pulses 42—42 from the positive polarity of the video pulses 43—43.

Figures 5, 6, 7, 8, 9, 10:
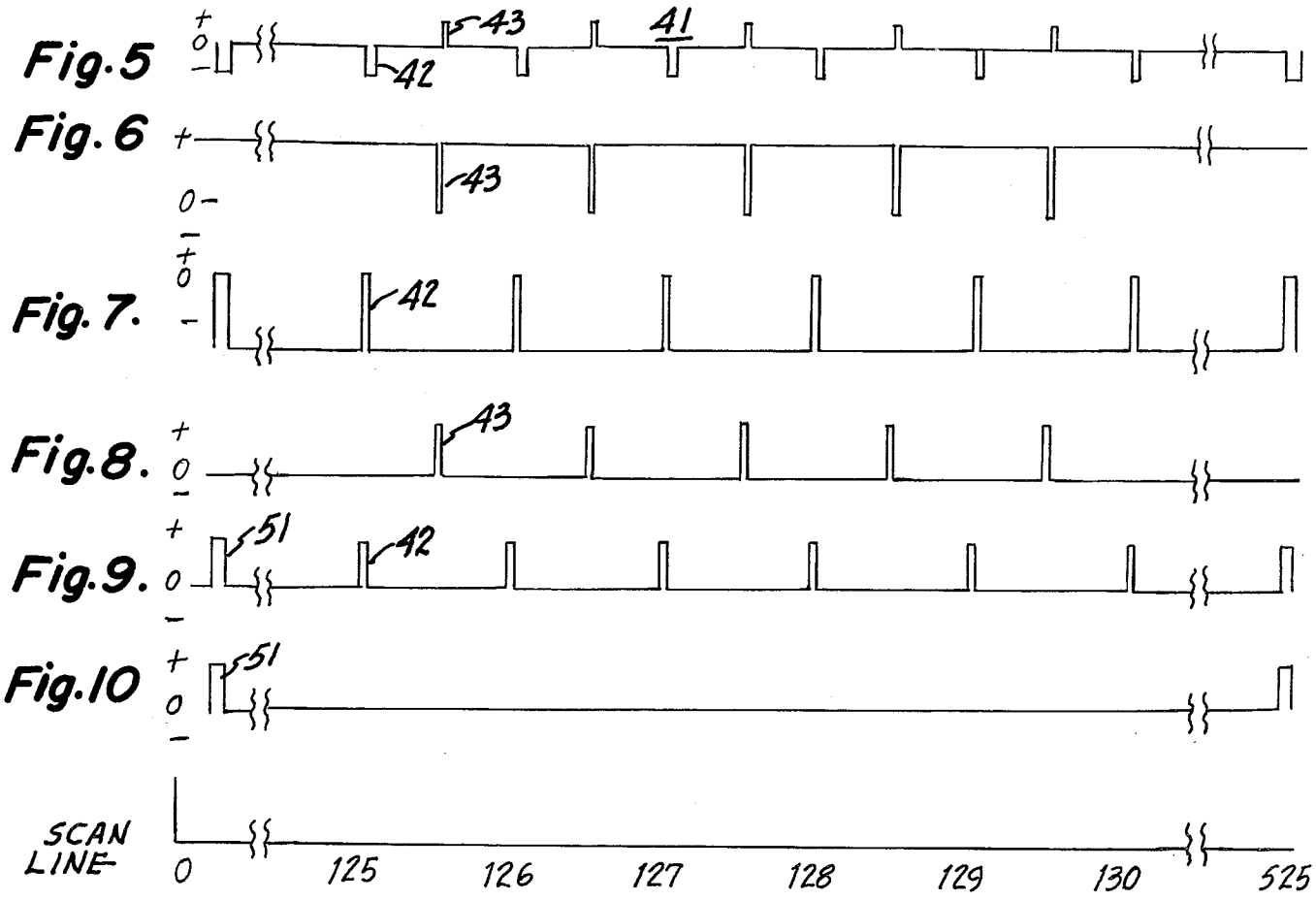
FIGS. 5 to 10 are pulse timing diagrams associated with the operation of the catenary controller video processor.

Since the video processor 28 is designed to operate with bi-level signal voltages rather than the analog gray tones of the normal video, the transistors 44 and 45 are built with very high gains and respond more like switches than classed type amplifiers. The signal voltages developed at the collectors of the transistors 44 and 45 are input to associated differential voltage sync pulse and video pulse comparators 47 and 48, respectively, which insure sync-video pulse separation and condition the output levels for circuit compatibility. The pulse output at the collector of the transistor 44 is shown in FIG. 6, while the pulse output at the collector of the transistor 45 is depicted in FIG. 7.

The composite output (see FIG. 9) from the synch comparator 48 contains both the horizontal scan line sync pulse 42 and the frame sync pulse 51. The output from the sync comparator 48 is applied to a frame sync separator 52 which separates the frame sync pulse 42 from the horizontal scan line sync pulse 42, as shown in FIG. 11. Separation is accomplished by allowing the longer frame sync pulse 51 to charge a capacitor sufficiently to drive a buffer. The buffer, belonging to a saturating logic family, generates a squared pulse slightly displaced in time from the original frame sync 51, which is used to clear a video existence counter 66. Additional timing signals are generated by the frame sync separator 52 in response to the horizontal scan line sync pulses 42 and the frame sync pulses 51.

The video existence counter 66 is used to confirm the existence of a viable image of the catenary 26. Vertically scanning the catenary 26 with the horizontal scans 36 (see FIG. 3) of the camera 32 causes the catenary image to be intersected by a plurality of horizontal scan lines in each frame. Each time one of the scan lines 36 intersects the image of the fiber catenary 26, a video pulse 43 is generated. The pulses appear at the output of the video comparator 47 (see FIG. 8) as a series of pulses 43—43; that is, one pulse in each intersected horizontal scan. The video pulses 43 are counted by the existence counter 66 to insure that at least ten consecutive scans intersect the image of the fiber catenary 26 per frame. There are other output taps, i.e., $n=3, 5, \ldots 10$, on the existence counter 66, which are used to enable other circuits as will hereinafter be described.

After the existence counter 66 counts three consecutive video pulses 43, a counter control flip-flop 67 is set which (a) enables pulses from a free-running 1 megahertz clock 70, via gate 71, to enter a bimodal video-pulse position counter 72 and also (b) enables the video pulses 43 to reset the position counter mode flip-flop 74 via mode selection gate 75, which controls the counting direction of the bimodal video pulse position counter 72. The position counter mode flip-flop 74 is set on the horizontal scan line sync pulse 42 (see FIG. 9) causing the video pulse position counter 72 to be an up counter until the video pulse 43 changes the mode to a down counter. In other words, a video pulse 43 precisely centered in the horizontal scan line produces a zero count output from the bimodal video pulse position counter 72, while a video pulse displaced from the center causes a sign and magnitude output proportional to the displacement.

The video pulse position counter 72 is reset on a pulse generated by a monostable multivibrator 76 which is triggered on the trailing edge of each horizontal scan line sync pulse 42. The video pulse position counter 72 continuously determines the video pulse positions from the third video pulse through to the tenth video pulse. When the existence count reaches five (5), an output is used to enable a latch gate 77 and the next horizontal scan line sync pulse 42 strobes the tentative data latch 78. This stores the position data from the video pulse position counter 72 which indicates the position of the fifth video pulse.

Accordingly, the bimodal video pulse position counter 72 will output position data associated with only one scan line in a frame comprising 525 scan lines. The output position data is that count determined during the fifth consecutive line scan containing an acceptable video signal 41. It should be clear that a relatively small portion of the fiber 11 reflects light toward the camera 32. Thus, the fifth acceptable scan will always be at or close to the lowest point of the fiber catenary 26. However, the video pulses 43 continue to be counted on the existence counter 66 until ten counts are generated to insure the received video signals represent the fiber 11. Once ten acceptable scans have been counted, the output of the existence counter 66 is then used to inhibit any further counting of the video pulses 43 and also triggers a second monostable multivibrator 79 which strobes an output data latch 80. This strobe transfers the data in the tentative latch 78 to the output data latch 80 and to the inputs of a digital-to-analog converter (DAC) 86. The DAC 86 is wired for a bipolar complementary-twos-complement configuration with an analog output voltage swing of minus ten to plus ten volts. The DAC 86 analog control voltage output 87 is input to a low pass filter 88 with a one second time constant and unity gain. The filtered output is attenuated by a potentiometer so that the output control gain may be adjusted. The filtered analog control voltage output is forwarded to the take-up motor 19 over the lead 29 to adjust the speed of the take up drum 18 to appropriately move the fiber catenary 26 towards an optimum position.

What is claimed is:

1. A method for automatically controlling the sag depth of a catenary of a material moving between a feed and a takeup apparatus, comprising the steps of:

illuminating the material in the vicinity of the lowest point of the catenary;

raster scanning the catenary vertically with a TV camera to provide a video output signal;

processing the video output signal to generate an output control voltage representing the displacement of the catenary image from a predetermined location; and adjusting the speed of the takeup apparatus in response to the generated output control voltage to control the sag depth of the catenary.

2. The method as set forth in claim 1, wherein the catenary is raster scanned by:

rotating the TV camera 90° about its optical axis to permit vertical scanning of the fiber using the horizontal line scan of the camera.

3. The method as set forth in claim 2, wherein the output voltage is obtained by:

generating a video pulse at the intersection of each horizontal line scan and the catenary image;

forming a digital representation of the vertical position of the video pulse on the line scan; and converting the digital representation into the output voltage.

4. The method as set forth in claim 3, wherein the digital representation is formed by:

up-counting repetitive clock pulses during the time from the start of the line scan to the appearance of the video pulse; and down-counting from the appearance of the video pulse until the end of the line scan, the final count being the digital representation.

5. The method as set forth in claim 4, wherein:

a selected one of the digital representations is stored; and the stored digital representation is converted into the output control voltage only after a predetermined number of consecutive, acceptable line scans have been received.

6. Apparatus for automatically controlling the sag depth of a catenary between a feed and a takeup apparatus, comprising:

means for illuminating the material in the vicinity of the lowest point of the catenary;

means for raster scanning the catenary vertically with a TV camera to provide a video output signal;

means for processing the video output signal to generate an output control voltage representing the displacement of the catenary image from a predetermined location; and means for adjusting the speed of the takeup apparatus in response to the generated output control voltage to control the sag depth of the catenary.

7. The apparatus as set forth in claim 6, wherein the catenary is raster scanned by:

rotating the TV camera 90° about its optical axis to permit vertical scanning of the fiber using the horizontal scan of the camera.

8. The apparatus as set forth in claim 7, which is further comprised of:

means for generating a video pulse at the intersection of each line scan and the catenary image;

means for forming a digital representation of the vertical position of the video pulse on each line scan; and means for converting the digital representation into the output voltage.

9. The apparatus as set forth in claim 8, which is further comprised of:

means for counting repetitive clock pulses during the time from the start of the line scan to the appearance of the video pulse; and means for reversing the counting of the clock pulses during the interval between the appearance of the video pulse and the end of the line scan, the final count be the digital representation.

10. The apparatus as set forth in claim 9, which further comprises:

means for storing a selected one of the digital representations; and the stored digital representation is converted into the output control voltage only after a predetermined number of consecutive, acceptable line scans have been received.

* * * * *